US007909704B2

(12) United States Patent
Giusti

(10) Patent No.: US 7,909,704 B2
(45) Date of Patent: Mar. 22, 2011

(54) TRAINING EQUIPMENT FOR GOLF PLAYERS

(76) Inventor: Ronnie Giusti, Ceparana (IT)

( * ) Notice: Subject to any disclaimer, the term of this patent is extended or adjusted under 35 U.S.C. 154(b) by 73 days.

(21) Appl. No.: 12/419,327

(22) Filed: Apr. 7, 2009

(65) Prior Publication Data

US 2009/0253529 A1 Oct. 8, 2009

(51) Int. Cl.
*A63B 69/36* (2006.01)

(52) U.S. Cl. ..... 473/278; 473/270

(58) Field of Classification Search ..... 473/278, 473/266, 270

See application file for complete search history.

(56) References Cited

U.S. PATENT DOCUMENTS

| | | | | |
|---|---|---|---|---|
| 4,248,431 | A * | 2/1981 | Burnes | 473/270 |
| 4,545,581 | A * | 10/1985 | Williamson | 473/270 |
| 4,805,913 | A * | 2/1989 | Bott | 473/218 |
| 4,915,387 | A * | 4/1990 | Baxstrom | 473/218 |
| 5,306,011 | A * | 4/1994 | Perry | 473/218 |
| 5,645,494 | A * | 7/1997 | Dionne et al. | 473/278 |
| 5,893,805 | A * | 4/1999 | Douglass | 473/218 |
| 5,954,592 | A * | 9/1999 | Laffer et al. | 473/220 |
| 6,932,712 | B2 * | 8/2005 | Cardosi | 473/261 |
| 7,131,910 | B2 * | 11/2006 | Townsend, II | 473/278 |
| 7,186,184 | B2 * | 3/2007 | Buck | 473/218 |
| 7,527,562 | B1 * | 5/2009 | Mason | 473/257 |
| 2001/0036869 | A1 * | 11/2001 | Grabowski | 473/270 |
| 2003/0190972 | A1 * | 10/2003 | Townsend, II | 473/278 |
| 2004/0077430 | A1 * | 4/2004 | Mindlin | 473/270 |
| 2004/0142758 | A1 * | 7/2004 | Shioda | 473/278 |
| 2005/0090323 | A1 * | 4/2005 | Kellogg | 473/218 |
| 2005/0090324 | A1 * | 4/2005 | Cardosi | 473/257 |
| 2005/0227774 | A1 * | 10/2005 | Buck | 473/218 |
| 2006/0194640 | A1 * | 8/2006 | Pelz | 473/270 |
| 2007/0173339 | A1 * | 7/2007 | Rivard | 473/266 |
| 2008/0051209 | A1 * | 2/2008 | Anton | 473/270 |
| 2008/0293509 | A1 * | 11/2008 | Lipidarov | 473/278 |
| 2009/0118028 | A1 * | 5/2009 | Tischler, II | 473/240 |
| 2009/0253529 | A1 * | 10/2009 | Giusti | 473/278 |

* cited by examiner

*Primary Examiner* — Raleigh W. Chiu
(74) *Attorney, Agent, or Firm* — Dennison, Schultz & MacDonald

(57) ABSTRACT

Training equipment for golf players that can be used by a golf trainee to execute a swing through a correct succession of movements of the body includes a mat (1) having a longitudinal dimension (2) and a transversal dimension (3). The mat (1) provides a support surface (1*a*) that is laid in a training area and a reference surface (1*b*) equipped with a plurality of reference signs with respect to which the golf trainee moves for follow corresponding body positions during a swing. On the reference surface (1*b*) of the mat (1) a golf ball reference position (11) is provided and two reference footprints (21, 22) are depicted at which the golf trainee stays with the right foot and with the left foot respectively. The mat (1) also includes a plurality of reference lines with respect to which the golf trainee orients the arms to reach a determined posture during a swing.

16 Claims, 15 Drawing Sheets

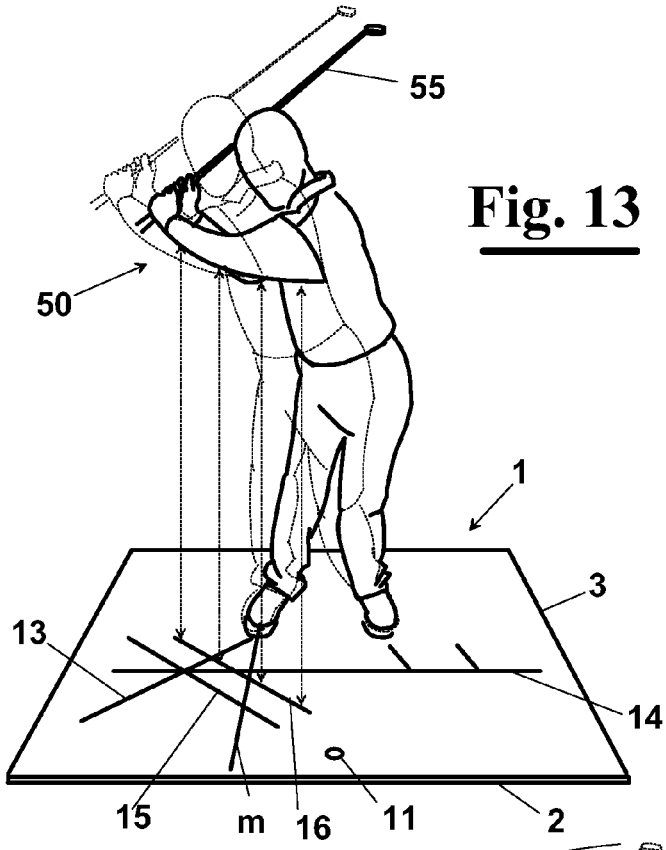
Fig. 13
Fig. 14
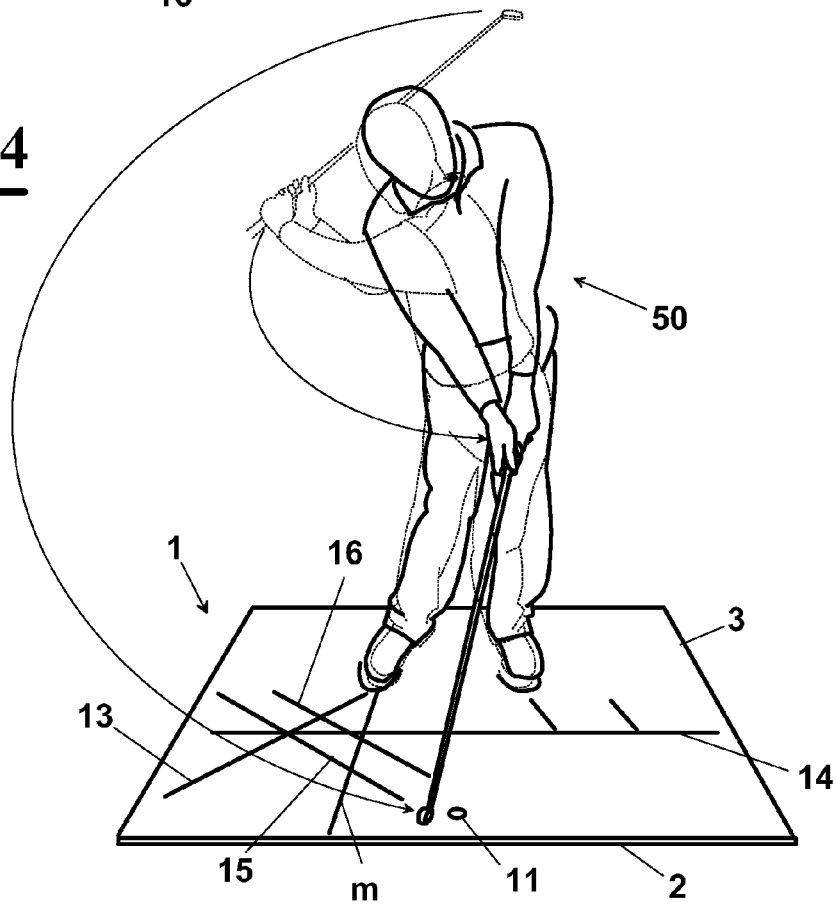

TRAINING EQUIPMENT FOR GOLF PLAYERS

FIELD OF THE INVENTION

The present invention relates to the sports field such as golfing and, in particular, it relates to a training equipment that can be used by a golfer for practicing the succession of movements of the body in a golf swing.

BACKGROUND OF THE INVENTION

As well known, the movements that a golf player executes with a golf club for hitting a golf ball are called "swing", i.e. "oscillation". The swing is an athletic movement that requires coordination, muscle elasticity, balance and explosive force.

More in detail, a swing can be seen as a precise succession of positions and actions. Even if a unique way of executing a swing does not exist and a skilled golf player finds a personal way of executing it, it is true that positions and actions exist that, if they are executed correctly, allow to obtain a right swing. Therefore, a golf trainer teaches to its trainee correct positions and actions in order to execute a right swing.

Various golf training devices are known that are used by golf players for improving their swing. Some of these devices allow simulating different situations and conditions that are observable during a golf competition.

For example, footboards exist that comprise portions of different material, for example tar-coated, turf-coated, and sand-coated portions, for simulating determined situations that may occur in golfing.

Another type of footboard that is used for practicing golf comprises a surface that can be at an angle, with a variable number of angles, with respect to the surface, in such a way that various situations that occur when playing on grounds with different morphological features are simulated.

Furthermore, mats are known on which different footprints are depicted that are used as reference for the feet. Each couple of footprints corresponds in particular to a correct position that the feet should have for executing correctly determined swings.

Other equipment used by golf players for practicing the swing comprises sophisticated and expensive devices such as sensors, which are applied to the garments of the golf trainee, or such as a videocamera for checking ad adjusting the movements, for example with comparison with motion pictures that have been previously recorded during golf competitions of professional players.

However, the above described equipment and other training equipment for golf players are not adapted to assist a trainee to teach the correct positions of the body that correspond to a correct swing.

SUMMARY OF THE INVENTION

It is therefore a feature of the present invention to provide a training equipment for golf players to assist a golf trainee for a correct movement of the body to execute a right swing.

It is another feature of the present invention to provide a training equipment for golf players that is easy to use.

It is also a feature of the present invention to provide a training equipment for golf players that is easily portable in order to carry it to a training area and to remove it at the end of the training time.

It is a particular feature of the present invention to provide a training equipment for golf players to assist individuals that are differently able to execute the correct movement of a swing.

These and other features are accomplished with one exemplary training equipment for golf players, according to the invention, which is suitable to assist a golf trainee to execute a correct succession of movements of a swing, said equipment comprising a mat, said mat having a longitudinal dimension and a transversal dimension and having a support surface that is adapted, in use, to be located next to a training area, said mat comprising, furthermore, a reference surface that is opposite to said support surface, said reference surface having:

- a golf ball reference position;
- reference footprints for the feet;
- a plurality of reference lines by means of which the golf trainee orients himself/herself to follow a succession of positions of the body;

wherein the plurality of reference lines comprises a determined number of arm guiding reference lines with respect to which the golf trainee orients the arms as a vertical projection from them in order to follow corresponding body positions according to a predetermined succession of positions.

Advantageously, the arm guiding reference lines comprise a determined number of reference lines that are at an angle with respect to a tangential line "t" that is tangent to both said reference footprints in respective points P1 and P2, respectively for a right and a left foot.

Advantageously, the reference lines that are at an angle with respect to said tangential line "t" comprise at least one line selected from the group comprised of:

- a first reference line at an obtuse angle $\alpha$ that is measured with respect to tangential line "t";
- a second reference line at an acute angle $\beta$ with respect to tangential line "t" that intersects the first reference line in a first point P;
- a third reference line that is substantially parallel to the second reference line and intersects the first reference line at a second point T.

However, it is also possible that the mat, according to the invention, has only one line, or only two lines, which are selected among the first, the second and the third reference line, as above described.

Advantageously, the first reference line passes through the point P1 of the right foot reference footprint and is at said angle $\alpha$ with respect to tangential line "t".

In particular, said angle $\alpha$ can be set between 130° and 140°, advantageously between 133° and 137°, preferably between 134° and 136°.

Advantageously, the golf ball reference position lays on a line "o" that is substantially orthogonal to tangential line "t," wherein said line "o" intersects said tangential line "t" at a determined point R in order to determine on it two portions p1 and p2, with p1 substantially equal to the double of p2 ($p1=2 \cdot p2$).

In particular, line "t" is substantially parallel to said longitudinal dimension.

Advantageously, along line "t" the distance between P1 and P2 is substantially equal to the distance existing between the shoulders of the golf trainee. Therefore, mats of different sizes can be made.

Advantageously, a reference line "n" is provided for the arms as a vertical projection from them that is substantially parallel to tangential line "t", said reference line "n" being located opposite to said footprint at a distance from said tangential line "t" equal to half the distance between P1 and P2.

Advantageously, the second reference line is at an angle $\beta$ that is set between 44° and 46° with respect to tangential line "t" and passes through an intersection point P' between the first reference line and reference line "n".

More precisely, reference line "n" passes through intersection point P between the first and the second reference line such that P≡P'.

Furthermore, a reference line "i" can be provided at an acute angle γ with respect to tangential line "t".

Advantageously, reference line "i" intersects the left foot reference footprint.

In addition, a reference line "l" can be provided that is substantially parallel to reference line "i" and is arranged more on the left side than reference line "i".

Advantageously, furthermore, a start line is provided that is substantially orthogonal to tangential line "t" and passes through point P1, such that said golf trainee aligns the view with said start line for determining a starting posture.

Advantageously, furthermore, a swing line "s" is provided that is parallel to tangential line "t" and that passes through reference position O for a golf ball. In particular, swing line "s" is followed by the golf trainee immediately before hitting the ball in order to reach the point of hitting the ball with a correct inclination of the body.

In addition, or alternatively, to swing line "s" a reference line "d" can be provided at an acute angle δ with respect to a line j that passes through the golf ball reference position and parallel to tangential line "t", said acute angle δ being defined starting from line j in a clockwise direction, said reference line "d" being followed by the golf trainee immediately before hitting the ball in case of a hit of "draw" type.

In particular, the amplitude of the angle δ can be set between 1° and 15°, advantageously between 5° and 12°, preferably between 8° and 10°.

In addition, or alternatively, a reference line "f" can be provided at an acute angle ρ with respect to a line j that passes through the golf ball reference position and parallel to tangential line "t", said acute angle ρ being defined starting from line j and going in a counter clockwise direction, said reference line "f" being followed by the golf trainee immediately before hitting the ball in case of a hit of "fade" type.

In particular, the amplitude of the angle ρ can be set between 1° and 10°, advantageously between 1° and 6°, preferably between 2° and 4°.

Therefore, in case both reference line "f" that reference line "d" are provided, they are arranged at opposite sides with respect to line j that passes through the reference position of the ball and parallel to line "r".

Advantageously, furthermore, can be provided a reference line "d'" that is parallel to reference line "d" and that passes through a point that is located between reference lines "i" and "l". In particular, reference line "d'" indicates the correct exiting trajectory of the hands of the golf trainee at the end of a "draw"-type swing.

Advantageously, furthermore, a reference line "f'" can be provided that is parallel to reference line "f" and that passes through a point that is located between reference lines "i" and "l". In particular, reference line "f'" indicates the correct exiting trajectory of the hands of the golf trainee at the end of a "fade"-type swing.

In addition, or alternatively, to the plurality of reference lines as above described, comprising the inclined lines, and the start line and the line "o", a second plurality of reference lines can be provided that are specularly symmetrical to the first plurality of reference lines in a transversal plane that passes through a middle point of line "t". This way the mat, according to the invention, is used both from left-handed players and by right-handed players. More in detail, the first plurality of reference lines is used for orienting a swing by right-handed players, whereas the second plurality of reference lines is used for orienting a swing by left-handed players.

According to another aspect of the invention, a proprioceptive footboard for athletes, in particular for golf players, comprises a lower surface that in use faces a support surface and an upper surface which is opposite to the support surface and on which the athlete rests on at least one foot, said lower surface being equipped with a base portion by means of which said proprioceptive footboard rests on the support surface, said base portion defining at least one rotation axis about which said footboard is free of rotating.

Advantageously, at least the lower surface of the proprioceptive footboard has a plane shape.

In particular, the base portion can be selected from the group comprised of:

- a rod having a polyhedral cross section and a measured width that is arranged longitudinally to said footboard;
- a body having a curved profile, for example a hemisphere.

In particular, the rod is arranged parallel to tangential line "t", said rod being such that said proprioceptive footboard is capable of rocking with respect to said rod by means of fluctuation of the body of the athlete, in order to provide a guide towards a correct position of balance of the body during determined exercises, for example during a succession of steps for executing a correct swing.

In particular, the equipment for golf players, according to the invention can comprise a proprioceptive footboard as above described, that in use is arranged at least at one of said footprints for the feet of said mat. In particular, the support surface can be a portion of the mat where the footprints for the feet are depicted.

Advantageously, the equipment for golf players, according to the invention comprises, furthermore, an elastic guide device for the wrist of the golf trainee during a swing, said elastic guide device comprising:

- a bracelet that is adapted to be constrained to an arm of the golf trainee;
- a resilient elongated element that is connected to the above described bracelet at an end, said resilient element at its other end engaging in use a finger of the golf trainee.

In particular, at a predetermined position, the resilient element assists the "loading" of the wrist of the golf trainee and limits the force of the arm, to which said elastic guide device is applied.

In particular, the device produces a returning resilient action of the wrist when the golf trainee assumes a posture that corresponds to said reference line "n".

Advantageously, furthermore, a support structure is provided for the supporting leg of the golf trainee, said support structure comprising an element that engages the leg below the knee.

In particular, the support structure can comprise:

- a base,
- a rod protruding from the base,
- an leg engaging element for the leg of the golf trainee near the knee, said leg engaging element having substantially "L"-shaped and being connected to said rod.

This way, the leg engaging element closes the knee during the loading step of the swing and leaves it free of moving during the descending phase of the swing.

In particular, the support has mutual engagement means with the rocking footboard.

Alternatively, the support has mutual engagement means with the mat.

BRIEF DESCRIPTION OF THE DRAWINGS

The invention will be now shown with the following description of an exemplary embodiment thereof, exemplifying but not limitative, with reference to the attached drawings in which.

Figure 1:
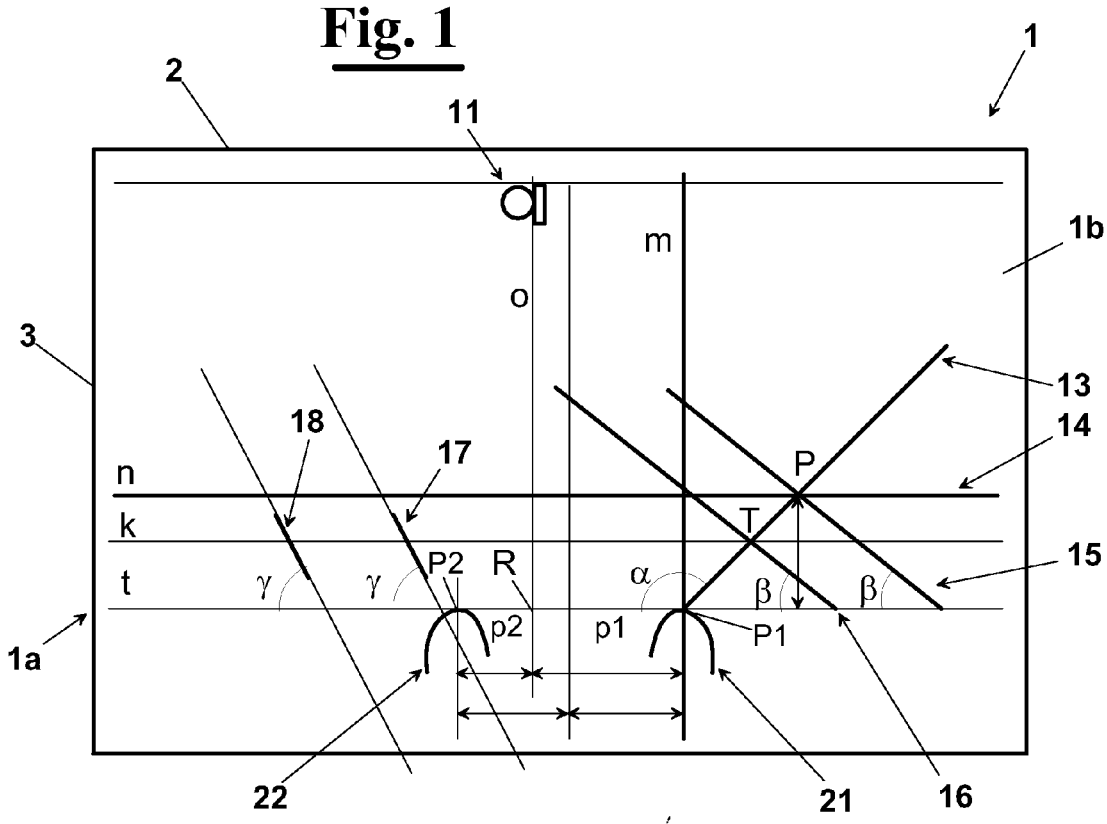
FIG. 1 shows a top plan view of a training mat for golf players, according to the invention.
Figure 17:
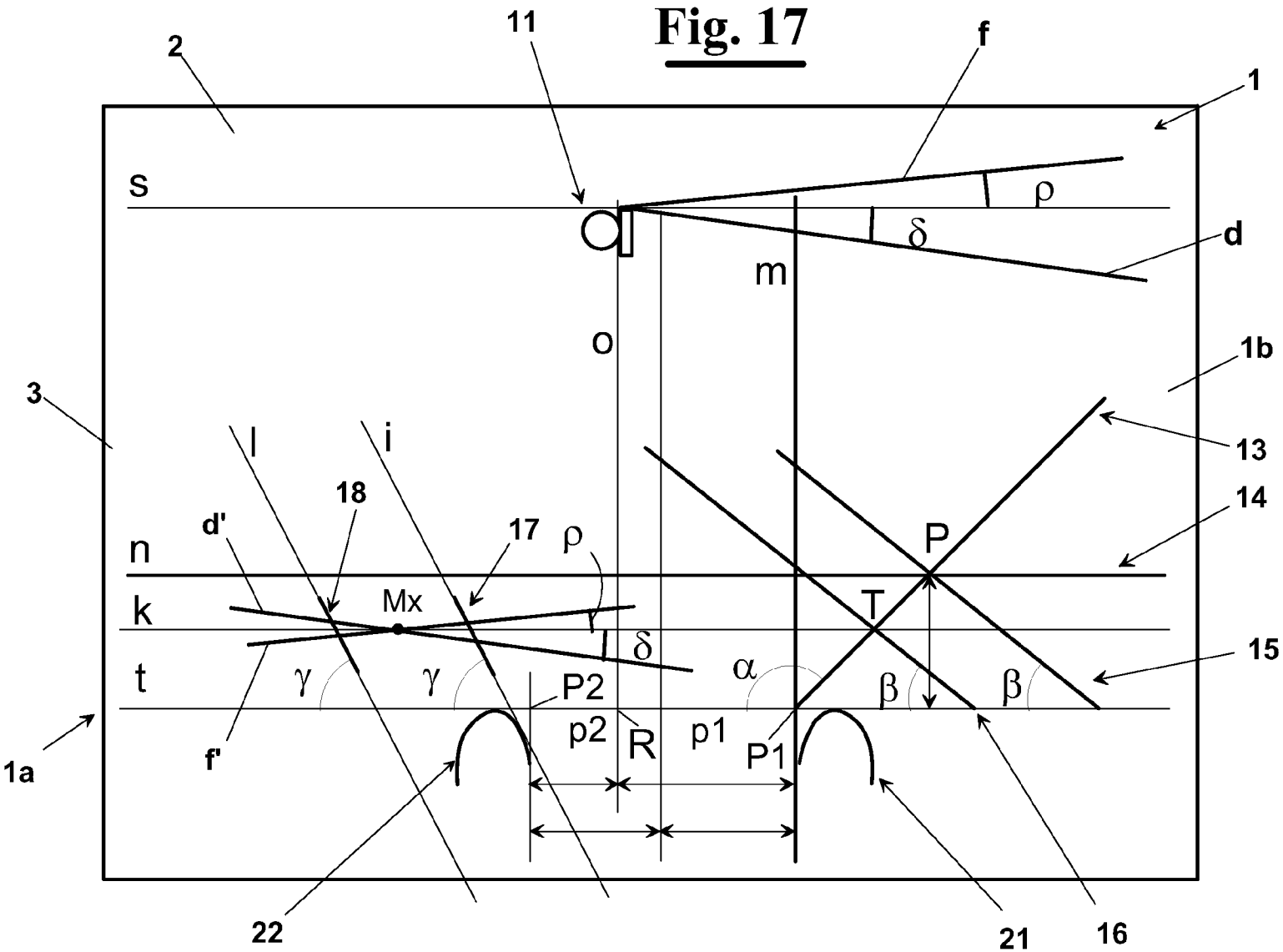
Figure 18:
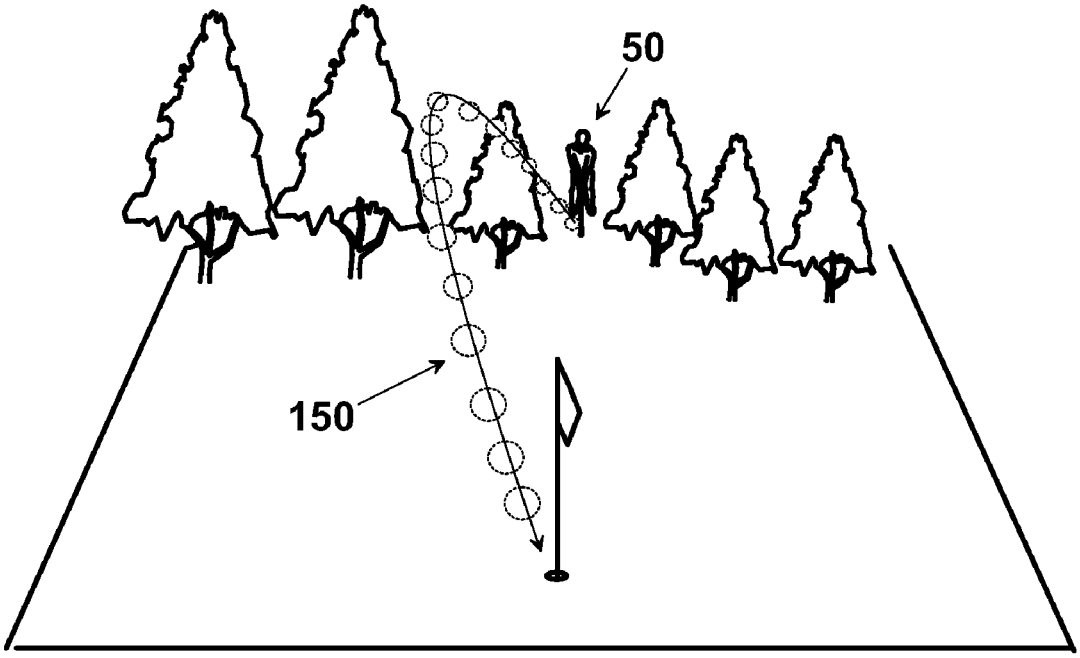
Figure 19:
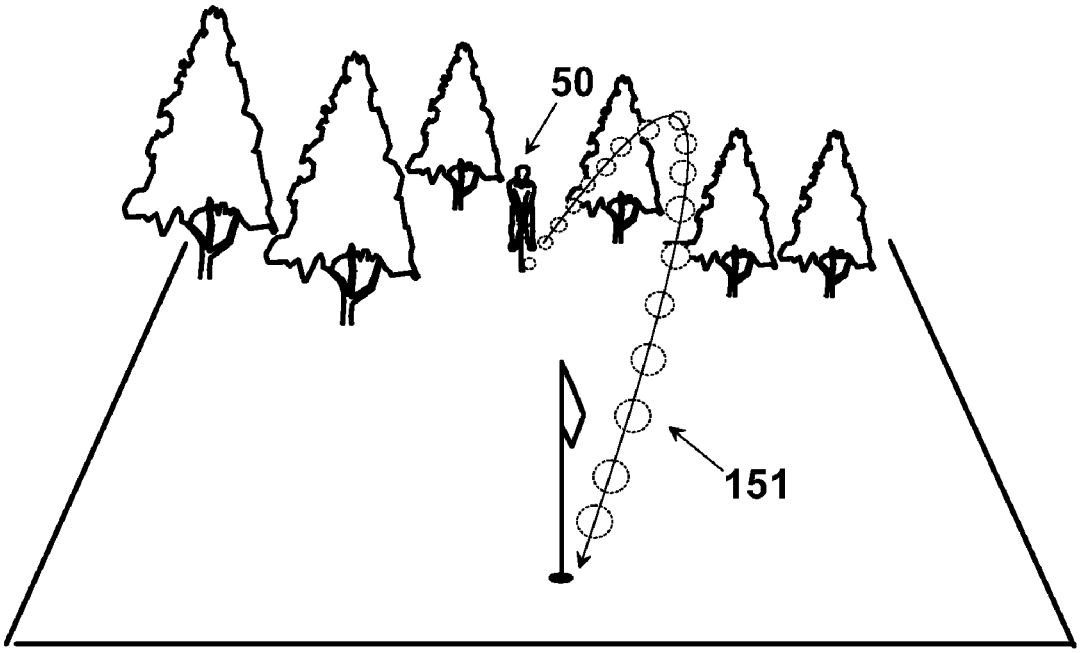
Figure 20:
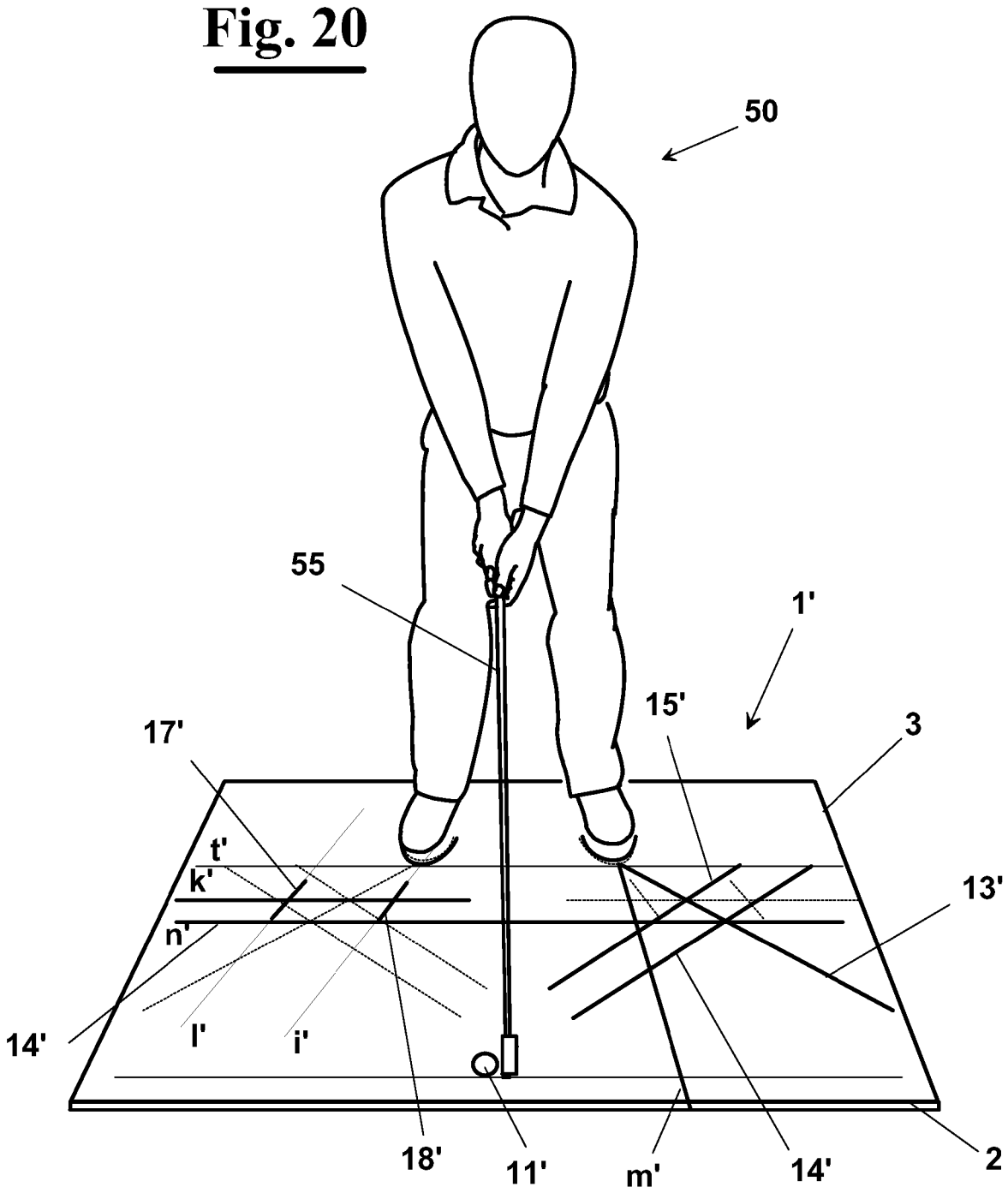
Figure 26:
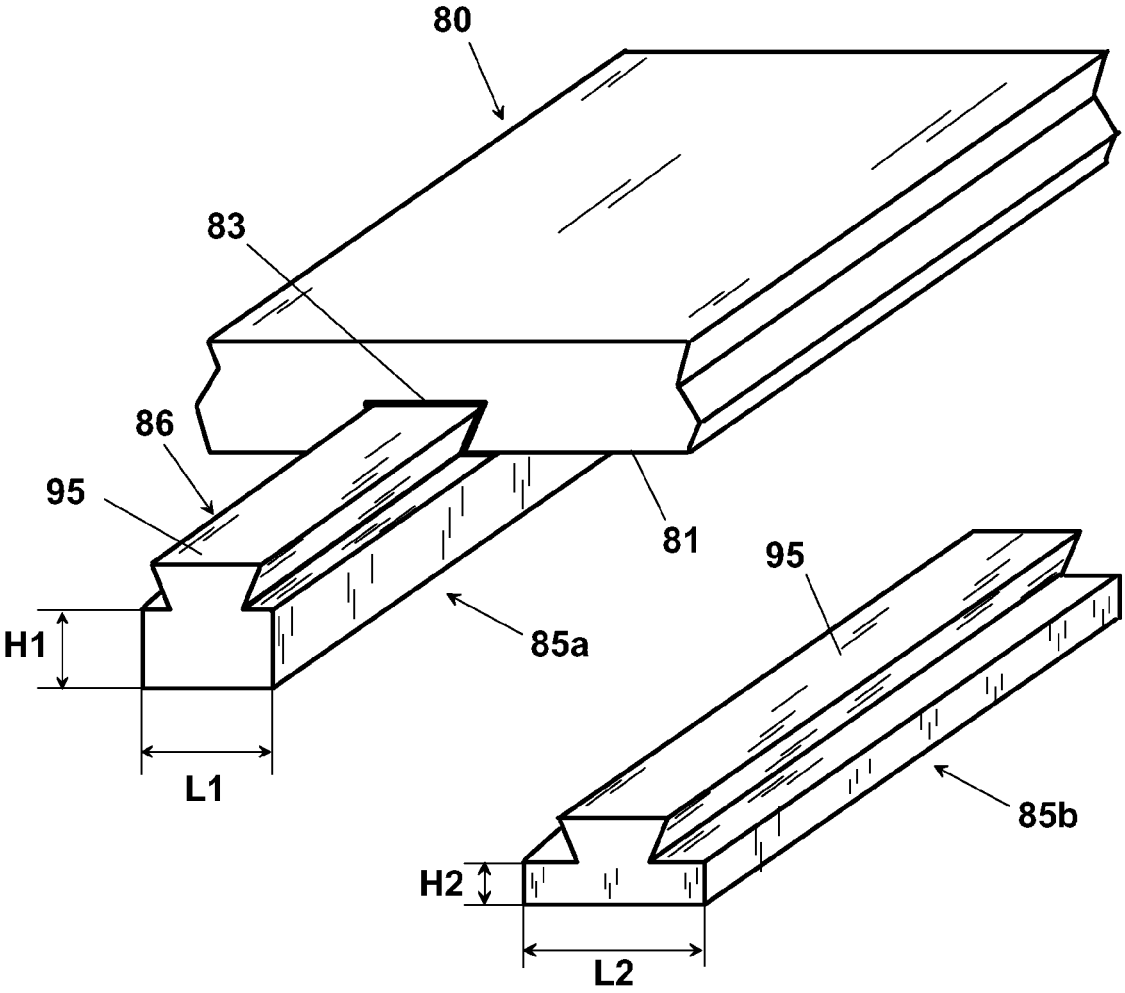
Figure 27:
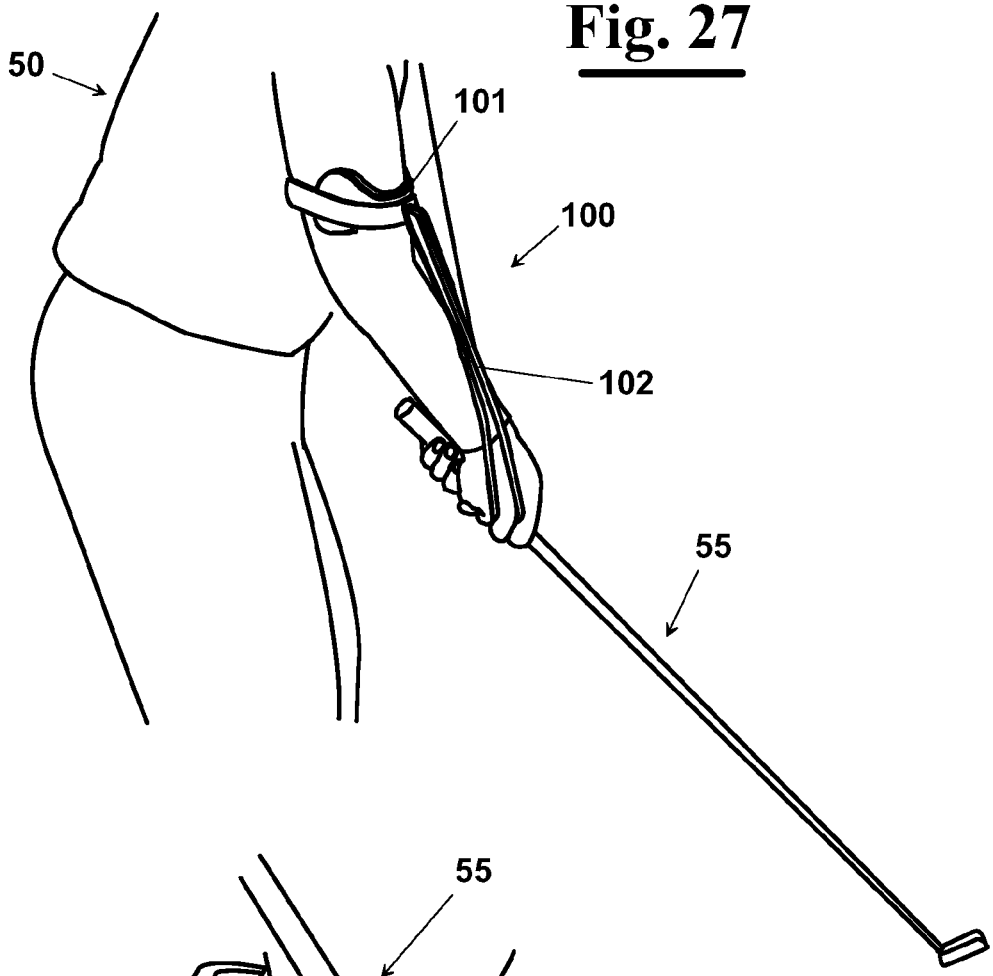
Figure 28:
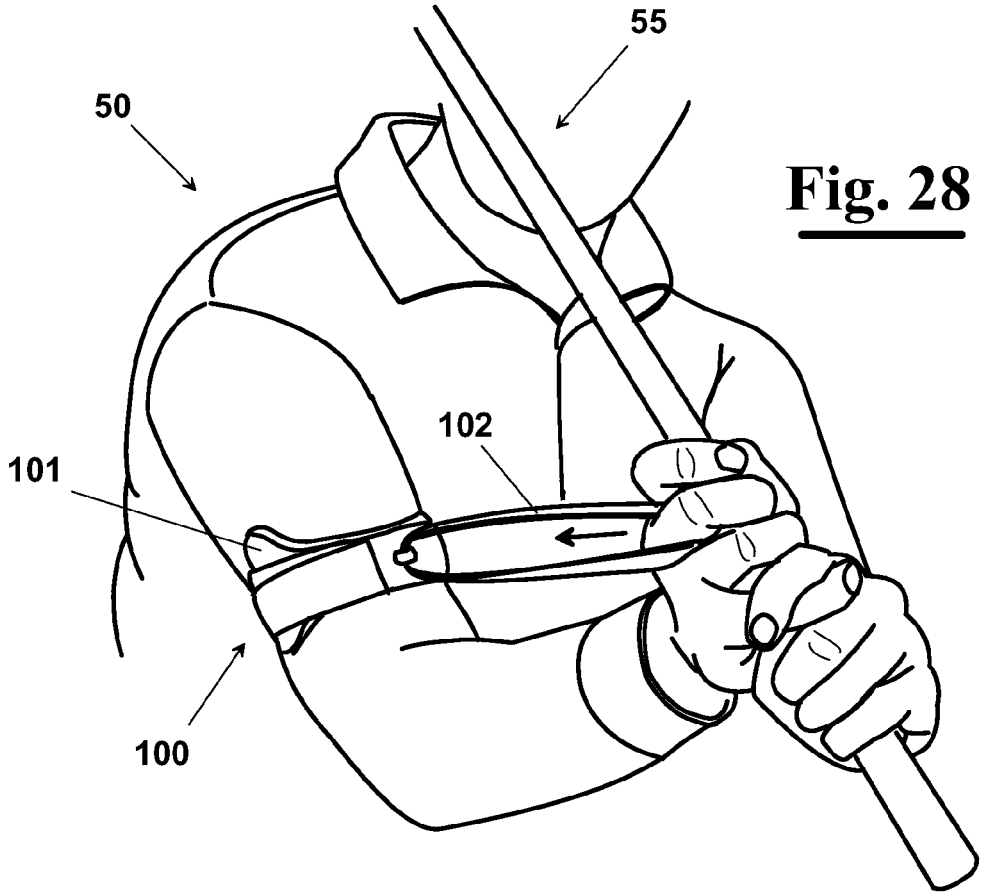

FIGS. from 3 to 16 show a golf trainee in different posture that are assumed during a swing when using the mat of FIG. 1;

FIG. 17 shows a top plan view of an exemplary embodiment of the training mat for golf players of FIG. 1;

FIGS. 18 and 19 show diagrammatically the trajectory of a draw swing and the trajectory of a fade swing, respectively obtainable with the exemplary embodiment of FIG. 17;

FIG. 20 shows a perspective top plan view of an exemplary embodiment of the mat of FIG. 1;

FIGS. from 21 to 25 show diagrammatically in different views the footboard, according to the invention, in different operative conditions;

FIG. 26 shows a perspective view from below of an exemplary embodiment of the footboard shown in Figs. from 21 to 24;

FIGS. 27 and 28 show perspective views of an elastic guide device for the wrist, according to the invention, to assist a golf trainee that uses the mat of FIG. 1, or of FIG. 20, to move the wrist in a predetermined position during a swing.

DESCRIPTION OF PREFERRED EXEMPLARY EMBODIMENTS

With reference to FIG. 1, a training equipment for golf players, according to the invention, which can be used by a golf trainee to execute a swing through a correct succession of movement of the various parts of the body, comprises a mat 1 having a longitudinal dimension 2 and a transversal dimension 3.

In particular, mat 1 provides a support surface 1*a* that is located in a training area, and a reference surface 1*b* that is equipped with a plurality of reference signs, shown hereafter in the detail, with respect to which the golf trainee moves to reach corresponding body positions during a swing.

More in detail, on reference surface 1*b* of mat 1*a* golf ball reference position 11 is provided, on which the golf ball can be put.

Furthermore, two reference footprints 21 and 22 are provided on which the golf trainee stays with the right foot and with the left foot respectively. Each footprint 21, 22 is U-shaped and it is possible to determine a tangential line "t" that is tangent to them respectively at a point P1 for the right footprint and at a point P2 for the left footprint, defining a segment P1-P2 on line "t". Reference footprints 21 and 22 are arranged at a distance that is substantially equal to the width of the shoulders. Therefore, each mat may have a customized "size".

Golf ball reference position 11 lays on a line "o" that is substantially orthogonal to tangential line "t". In particular, line "o" intersects line "t" at a determined point R defining on it two portions p1 and p2, with p1 substantially equal to the double of p2.

Figure 4:
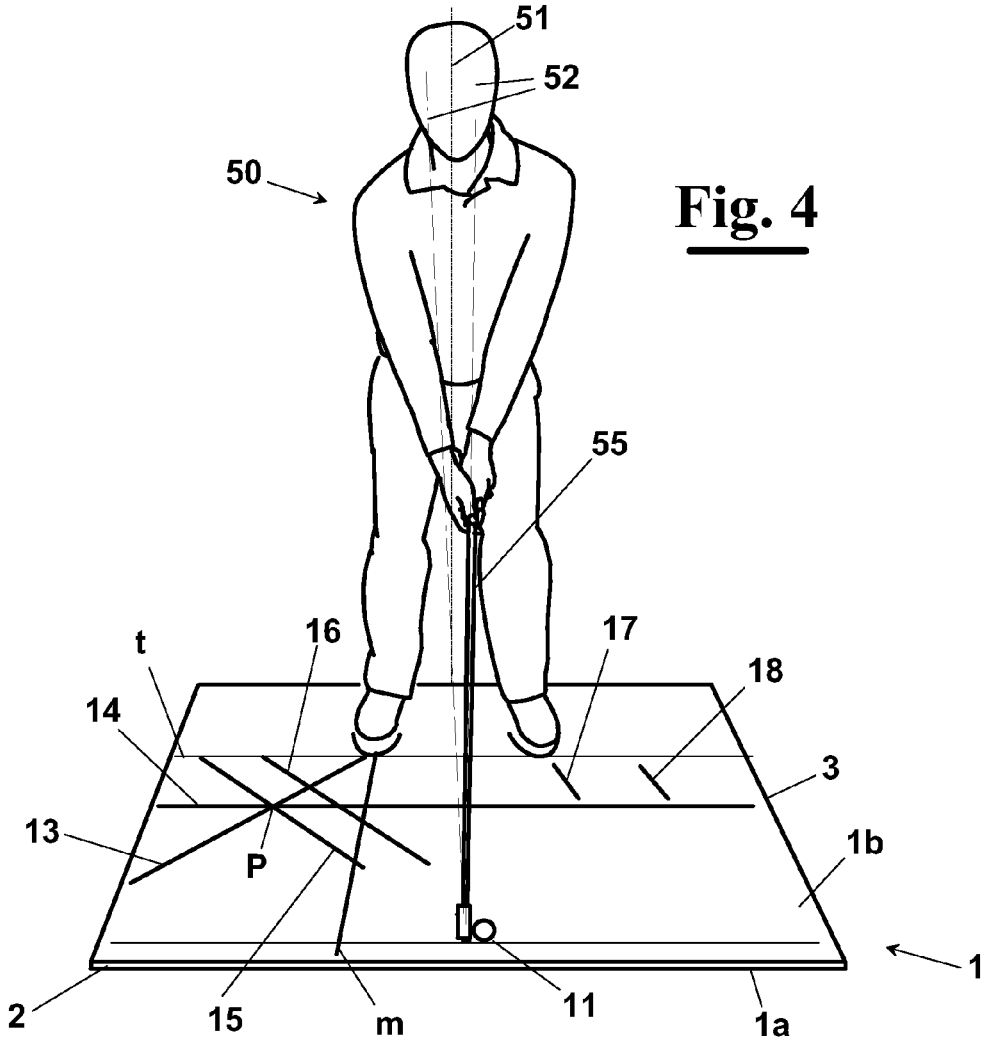
Figure 5:
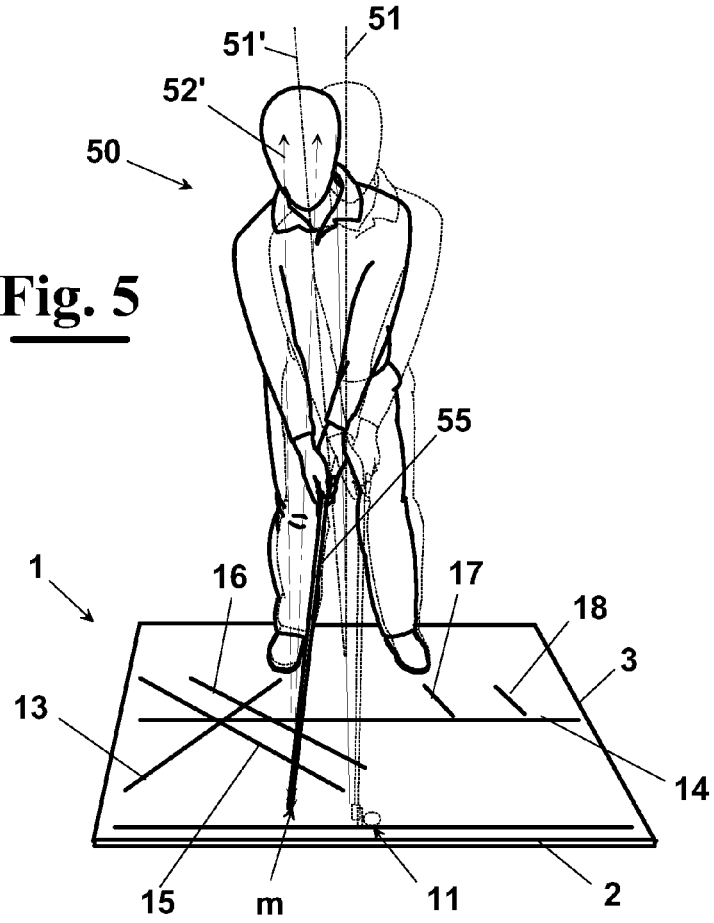

Furthermore, a start line "m" is provided orthogonal to tangential line "t" passing through point P2 of the footprint for the right foot. In particular, starting from a starting position, as diagrammatically shown in FIG. 4, in which the golf trainee 50 has the feet on reference footprints 21 and 22 and the back that is bent forwards at an angle such that, when the arms are extended and the hands touch the knees, the golf trainee 50 aligns the view with the start line m for find a starting posture for the swing (FIG. 5).

Figure 2:
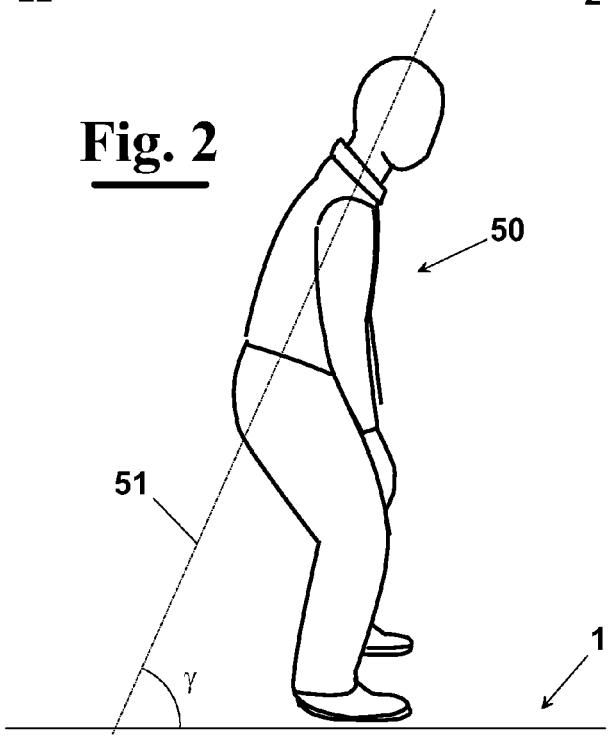
FIG. 2 diagrammatically shows an elevational side view of a correct starting posture that a golf trainee assumes when using the mat of FIG. 1.
Figure 3:
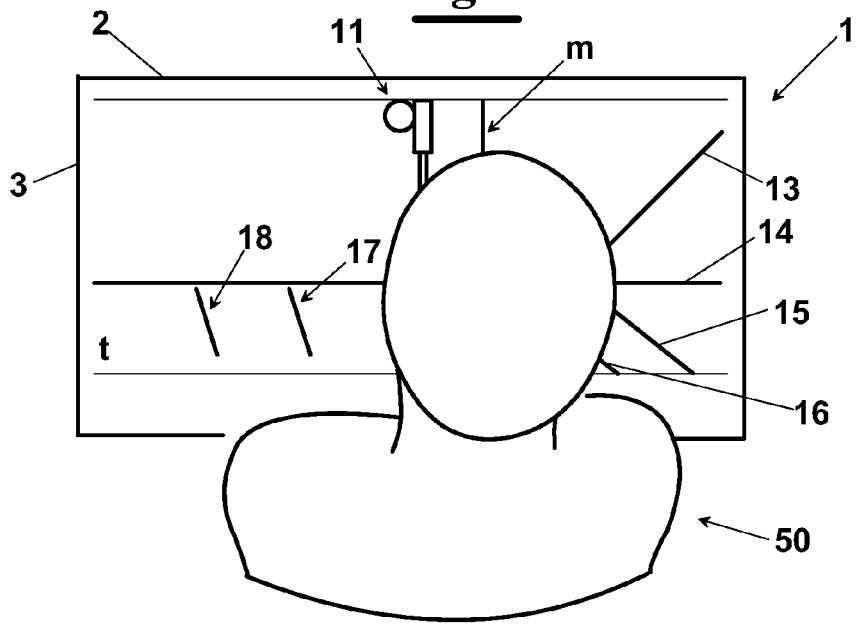

More in detail, in the starting posture (FIGS. 2-4), the body axis 51 of the golf trainee 50 lays in a plane at an angle $\lambda$ with respect to mat 1 (FIG. 2). In this starting posture the golf trainee 50 turns the view towards the golf ball reference position 11 as diagrammatically indicated by lines 52 of FIG. 4. From the initial posture, golf trainee 50 moves to the starting posture, in which most of the body weight is born by the right leg. The passage from the initial posture to the starting posture is executed by the golf trainee keeping the head still and inclining the body up to capturing the view of line m, which is located at the right of the golf ball reference position 11. In the starting posture the golf trainee 50 has its body axis 51' at an angle with respect to the body axis 51 of the initial posture (FIG. 5).

Figure 6:
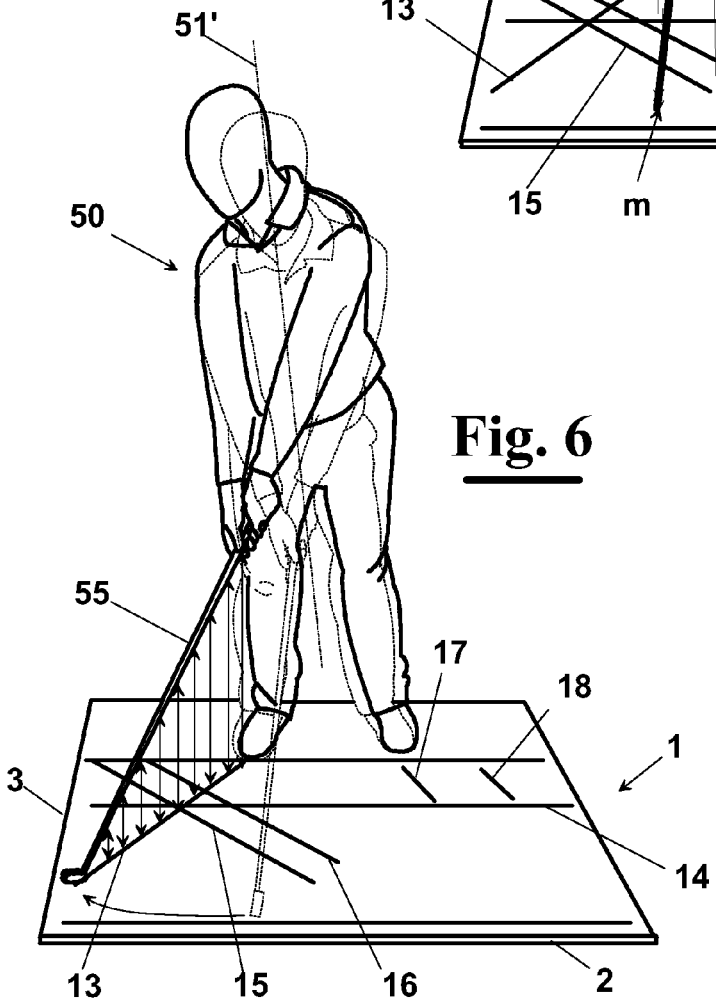
Figure 7:
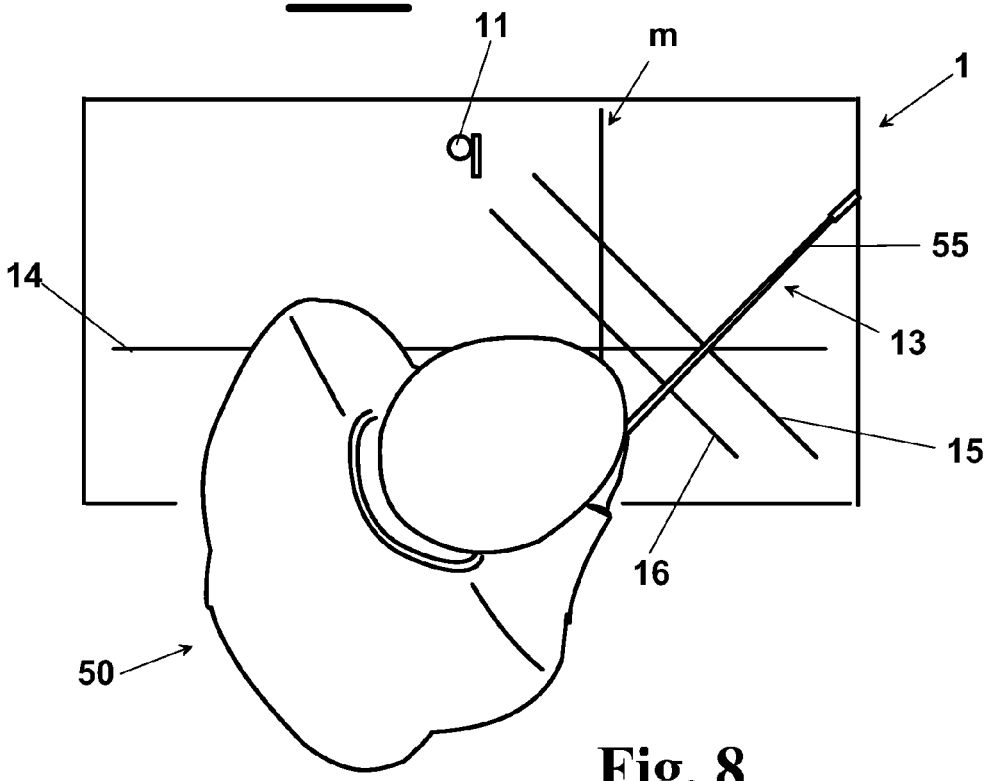

On reference surface 1*b*, furthermore, reference lines 13-16 are traced as arm guiding references for the golf trainee 50 such that the arms can be arranged in body positions that in turn allow to execute a correct swing. More in detail, from the starting posture of FIG. 5, the golf trainee 50 rotates the shoulders in a clockwise direction about its body axis 51' up to capturing with the view a reference line 13 at a determined angle $\alpha$, for example 135°, with respect to tangential line "t", eventually assuming the posture shown in FIG. 6. As shown in FIG. 7, the use of a golf club 55 can assist the golf trainee 50 to achieve the correct position with respect to reference line 13; in fact, once achieved such position the golf trainee 50 sees the golf club 55 that is aligned with line 13.

Figure 8:
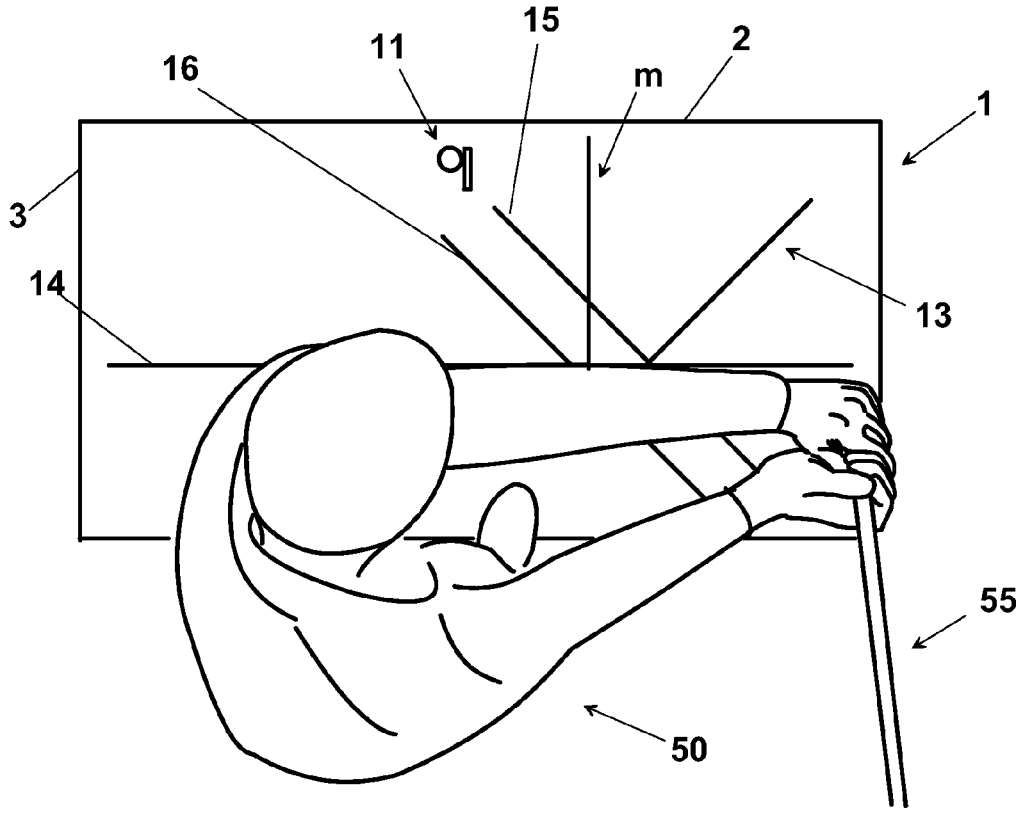
Figure 9:
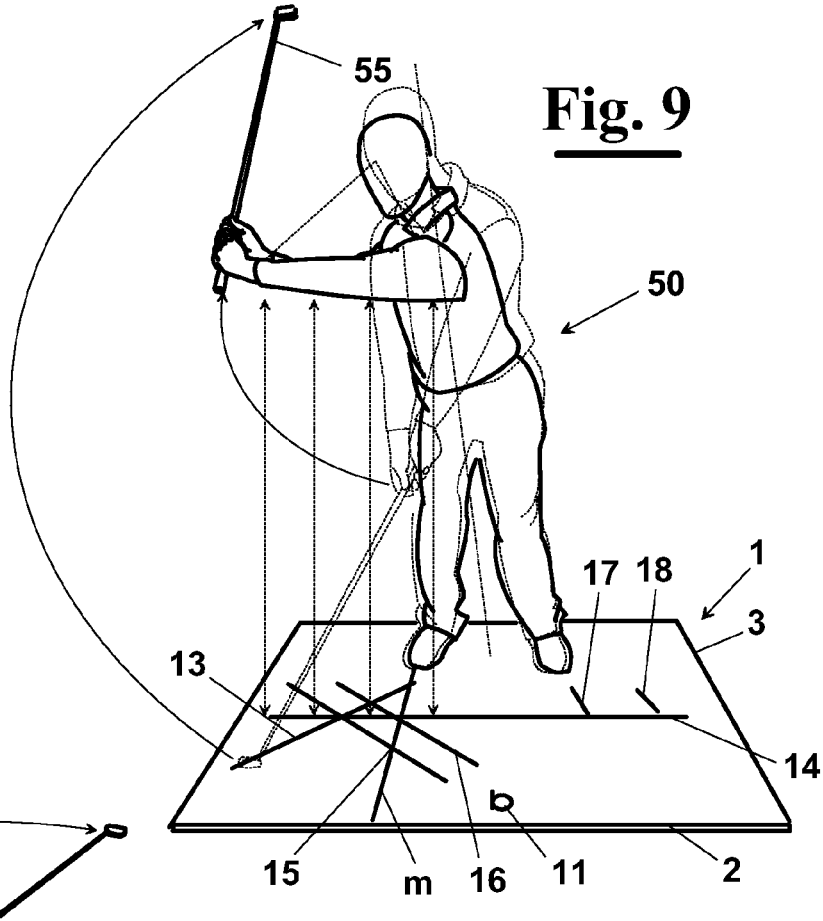

Then, golf trainee 50 continues to rotate the shoulders about body axis 51' up to see left arm in an extended position and arranged along a reference line 14 that is substantially parallel to tangential line "t" and at a distance d1 from it, with d1 that is about half the distance P1-P2 (FIGS. 8 and 9).

Figure 10:
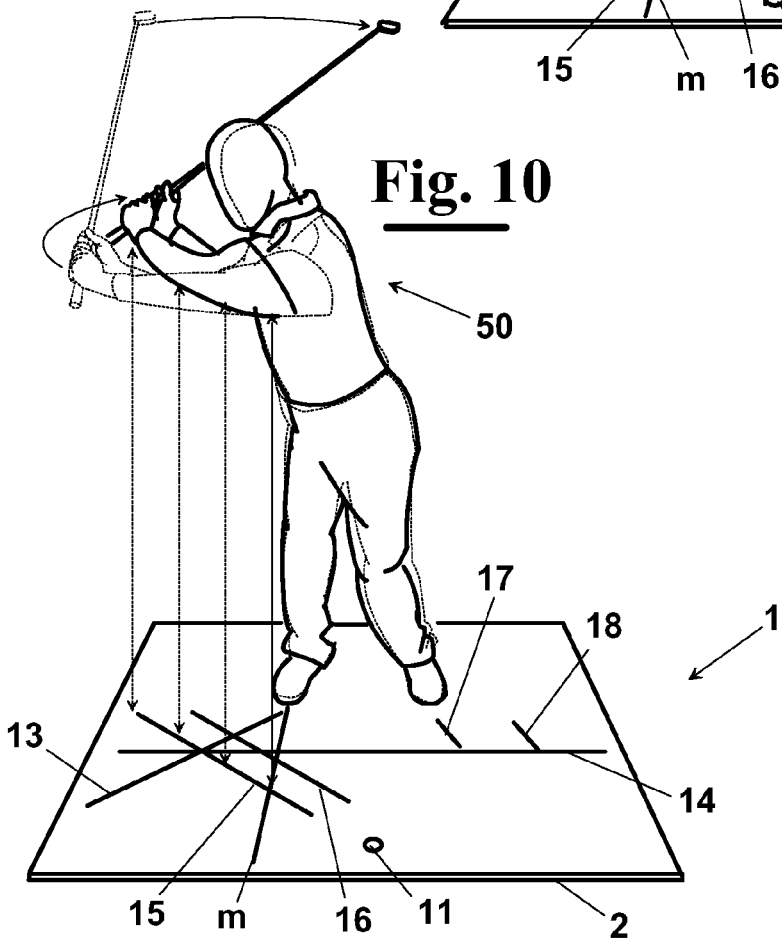
Figure 11:
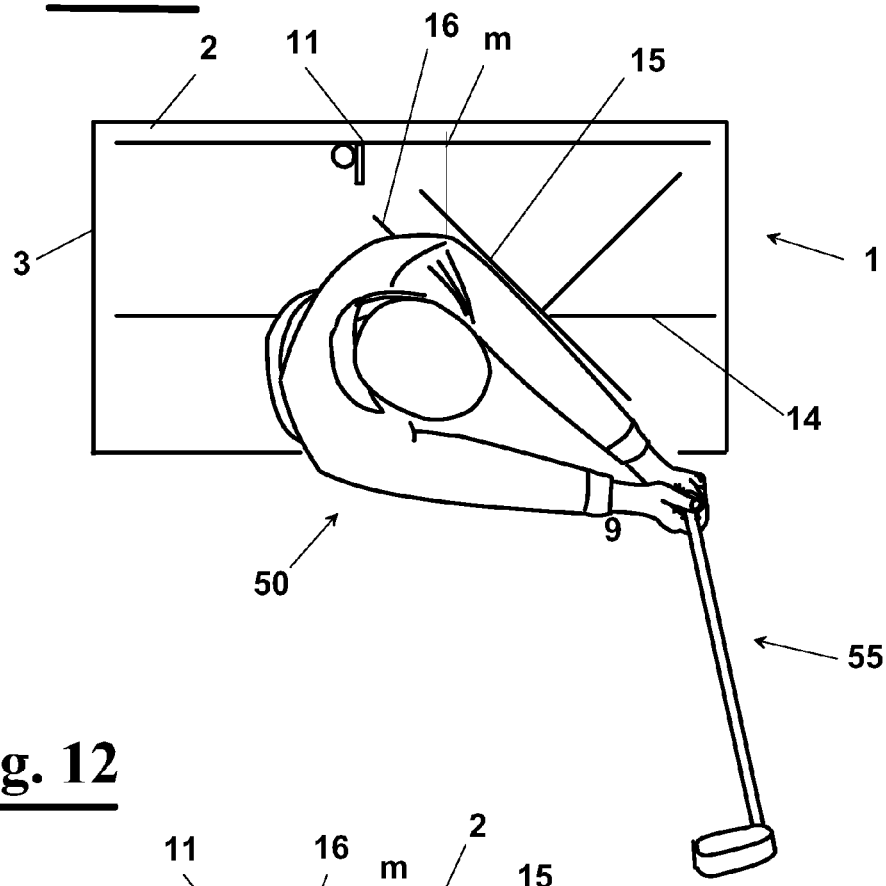
Figure 12:
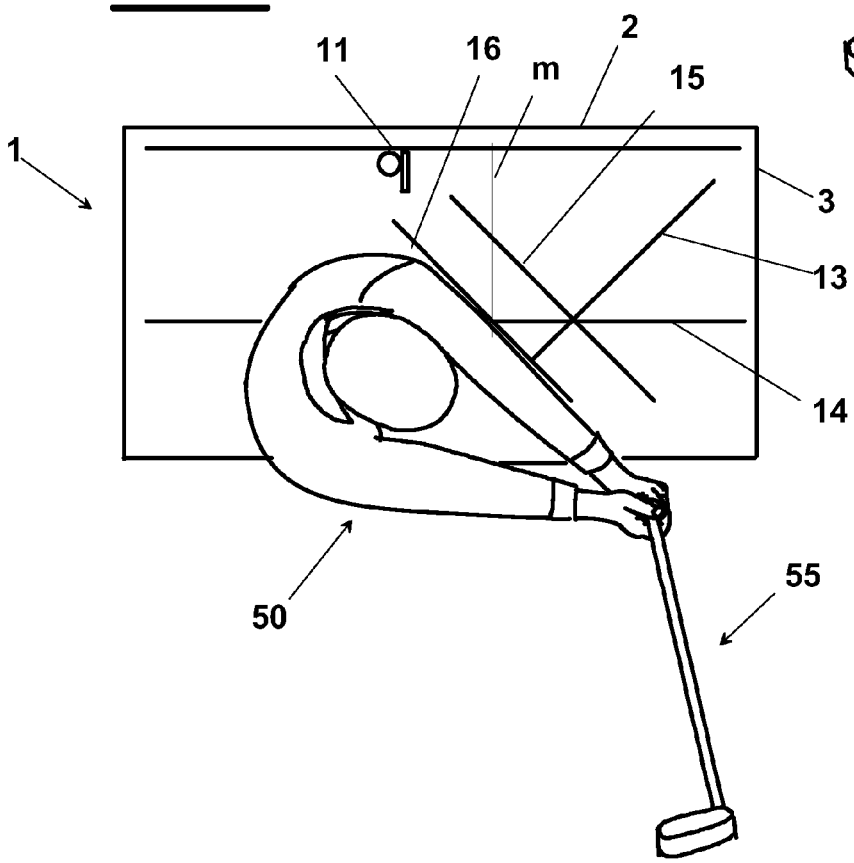

A further rotation of the shoulders about axis 51' in a clockwise direction brings the projection of the left arm of the golf trainee 50 along a reference line 15 at a determined angle $\beta$, for example 45°, with respect to tangential line "t" and passing through intersection point P between reference line 13 and reference line 14 (FIGS. 10 and 11). From this posture, golf trainee 50 moves the body weight bearing on the left leg, thus assuming a posture in which left arm is seen that is aligned on a reference line 16, which is substantially parallel to reference line 15 (FIGS. 12 and 13). In this posture the arms of the golf trainee 50 achieve the highest position of the sequence that ends with the swing.

Figure 15:
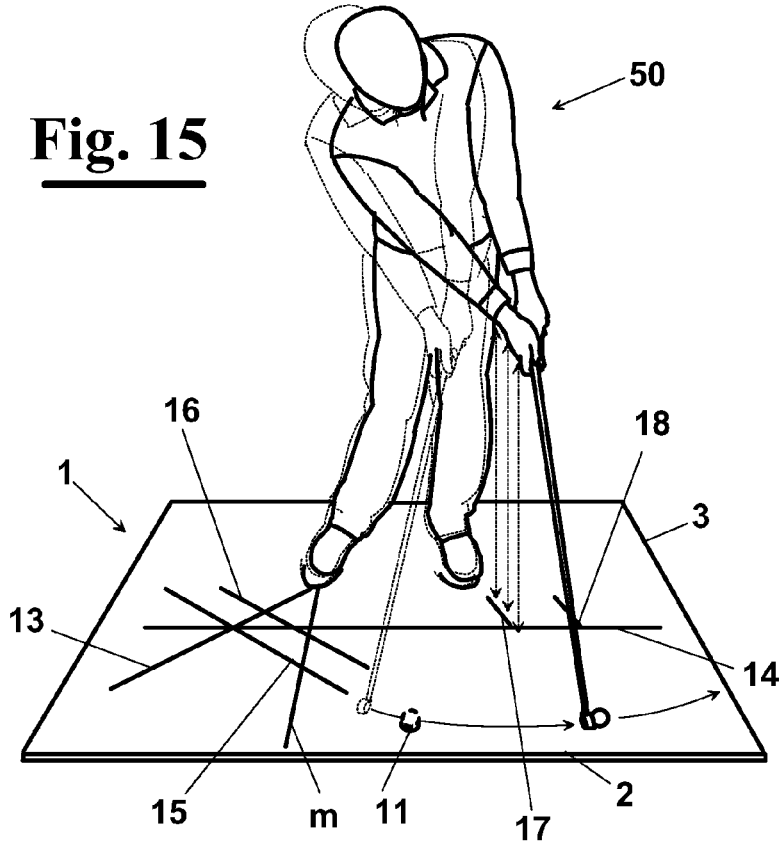
Figure 16:
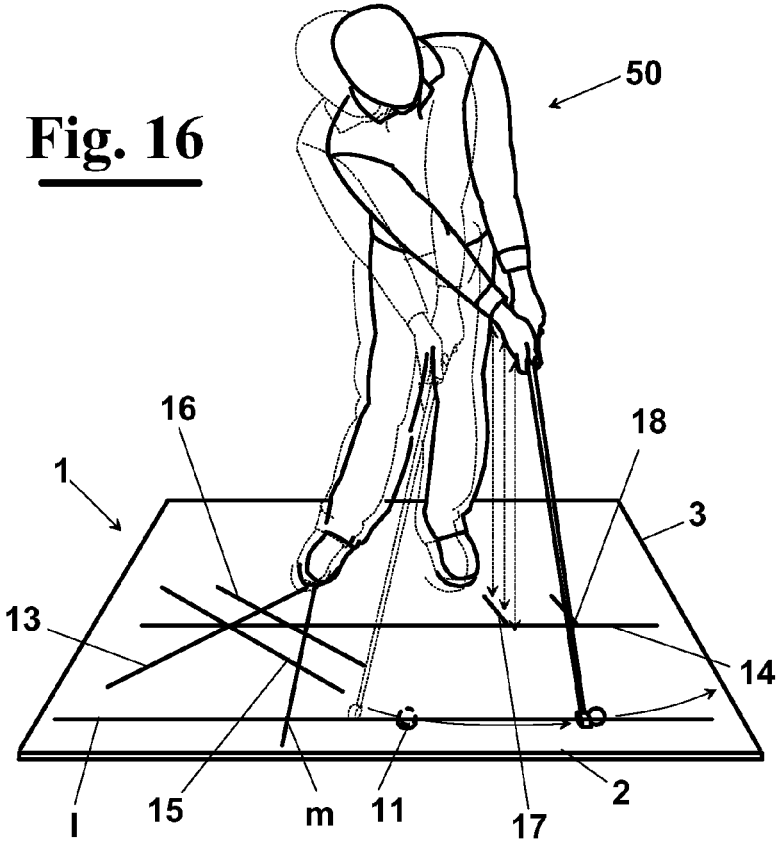

A step follows of descent during which the golf trainee 50 rotates the shoulders in a counter clockwise direction about an body axis 51, passing golf ball reference point 11 (FIG. 14) and running through a first and a second exit position at which the projections of the hands on mat 1 are aligned firstly with a reference line "i" at a portion 17 (FIG. 15) and then with a reference line "l" at a portion 18, not shown in the figures. In particular, line "i" intercepts the left foot footprint 22, whereas reference line "l" is arranged more on the left side than it (FIG. 1). Furthermore, the lines "i" and "l" intersect a line "k", or hands reference line, which is arranged between line "t" and line "n", which the golf trainee 50 uses as reference for exit direction of the movements.

Even if in F*igs*. from 1 to 13 the golf trainee 50 has a golf club 55, during the training steps with the mat 1, the execution of a succession of postures at the end of which the golf trainee executes a correct swing does not require necessarily the use of a golf club 55.

Furthermore, a swing line "s" can also be provided parallel to tangential line "t" and that passes through reference position O for the golf ball. In particular, swing line "s" is followed by the golf trainee immediately before hitting the ball in order to hit the ball with a correct inclination of the body.

In addition or alternatively to swing line "s", a reference line "d" can be provided at an acute angle δ with respect to line "l", starting from it in a clockwise direction. In particular, the amplitude of angle δ can be set between 1° and 15°, advantageously between 5° and 12°, preferably between 8° and 10°. In particular, reference line "d" lets the golf trainee to achieve a correct shooting direction of the ball when a "draw"-type swing has to be executed.

For executing in a correct way a draw swing, the feet and the body of the player have to be closed, i.e. in line with the club on the ground in order to provide a "closed" impact under the ball. This way, a spin is obtained on the ball from the right to the left side, with a subsequent trajectory 150 of the same from the left to the right side (FIG. 18).

In addition, or alternatively, a reference line "f" can be provided at an acute angle ρ with respect to the swing line "s", where acute angle ρ is defined starting from swing line "s" in a counter clockwise direction. Reference line "f" allows the golf trainee to arrange itself in a correct direction of impact with respect to the ball when a "fade"-type swing has to be executed. In particular, the amplitude of angle ρ can be set between 1° and 10°, advantageously between 1° and 6°, preferably between 2° and 4°.

In particular, in a fade swing the body of the player must achieve an open position so that the head of the golf club hits the ball with an "inward/outward" effect such that the spin causes a trajectory 151 of the ball that is curved from the right to the left side (FIG. 19).

Furthermore, a reference line "f'" and a reference line "d'" can be provided that are respectively parallel to reference lines "f" and "d" and that pass through a point that is located between reference lines "i" and "l". In particular, the reference line "d'" indicates the correct exiting trajectory of the hands of the golf trainee at the end of a "draw"-type swing. For example, the lines "f'" and "d'" pass for a point Mx that is at a same distance from reference lines "i" and "l" and belong to line "k".

Similarly, reference line "f" indicates the correct exiting trajectory of the hands of the golf trainee at the end of a "fade"-type swing (FIG. 17).

Mat 1, as above described with reference to F*igs*. from 1 to 17, is particularly indicated for a golf trainee that uses preferentially the right part of the body, in particular right leg and right arm, for the swing.

However, in an exemplary embodiment shown in FIG. 20, a mat 1' can be provided that can be used also from left-handed players. This mat 1' is, in fact, in addition to the above described reference lines and reference signs above described, has also reference lines 13'-18', a golf ball reference position 11' and a start line m', that are traced in symmetric positions to the above described reference lines and positions, with respect to a plane that is orthogonal to mat 1 and passes through a middle point M thereof.

In a further exemplary embodiment of the invention, not shown in the figures, on the reference surface of the mat only reference lines 11'-18' are traced, obtaining a mat for left-handed players only.

The training equipment, according to the invention, in addition to mat 1, or 1', can comprise also a proprioceptive footboard 80, as shown in F*igs*. from 21 to 26.

Figure 21:
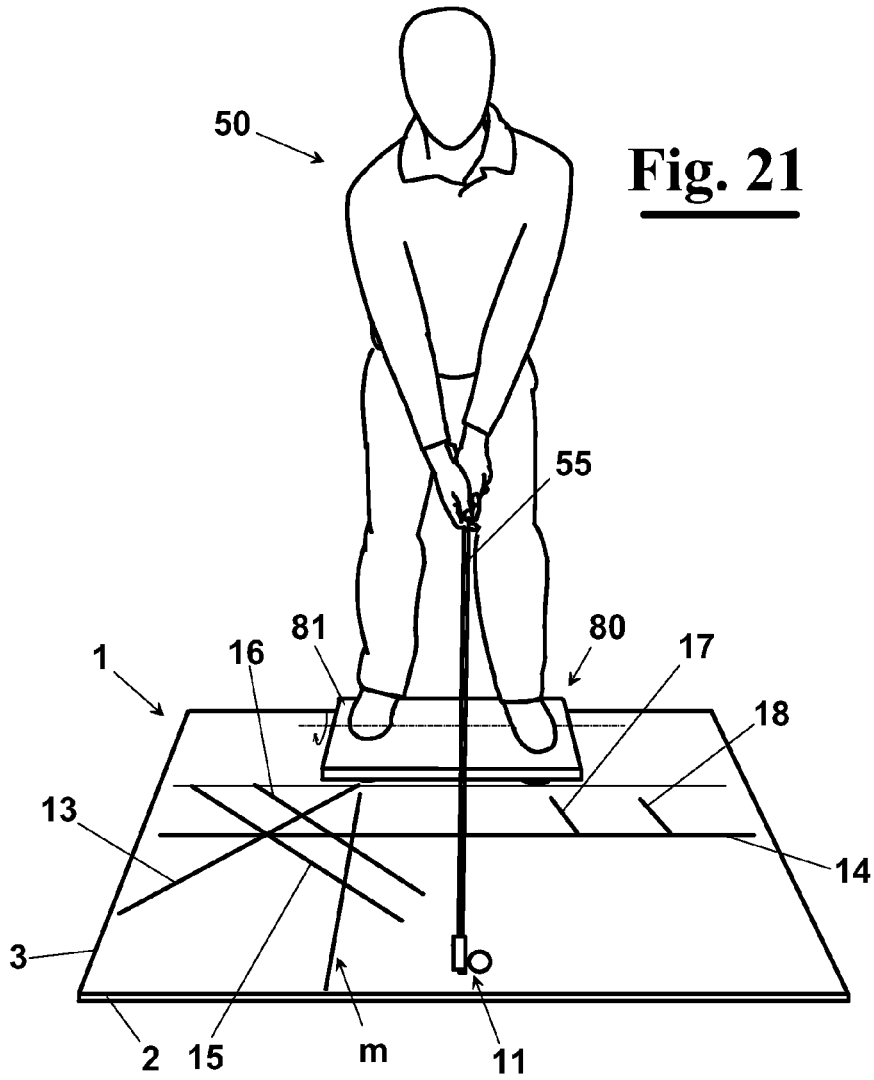
Figure 22:
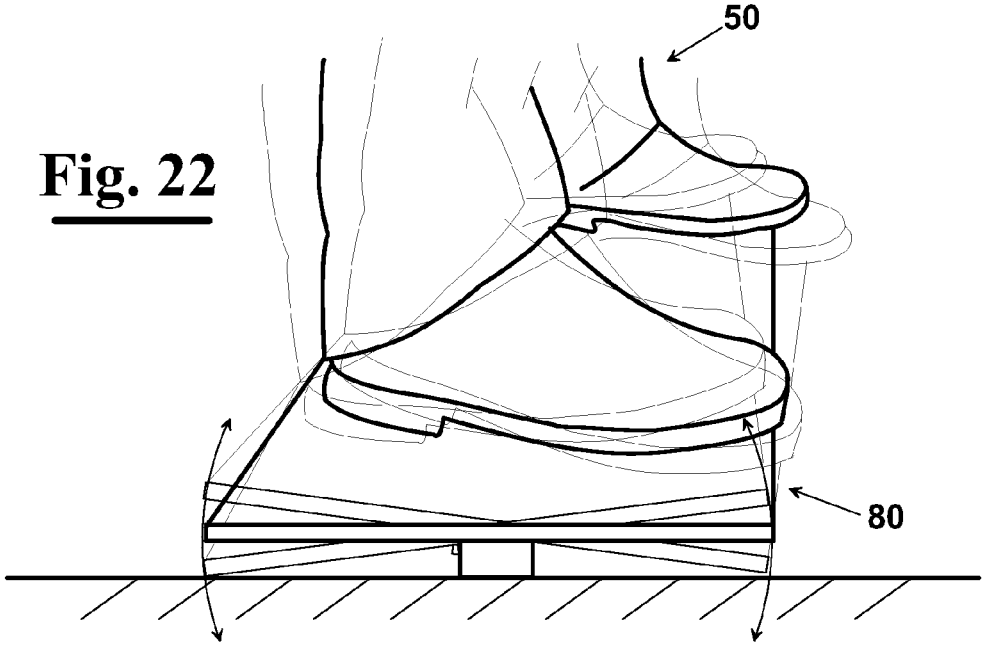
Figure 23:
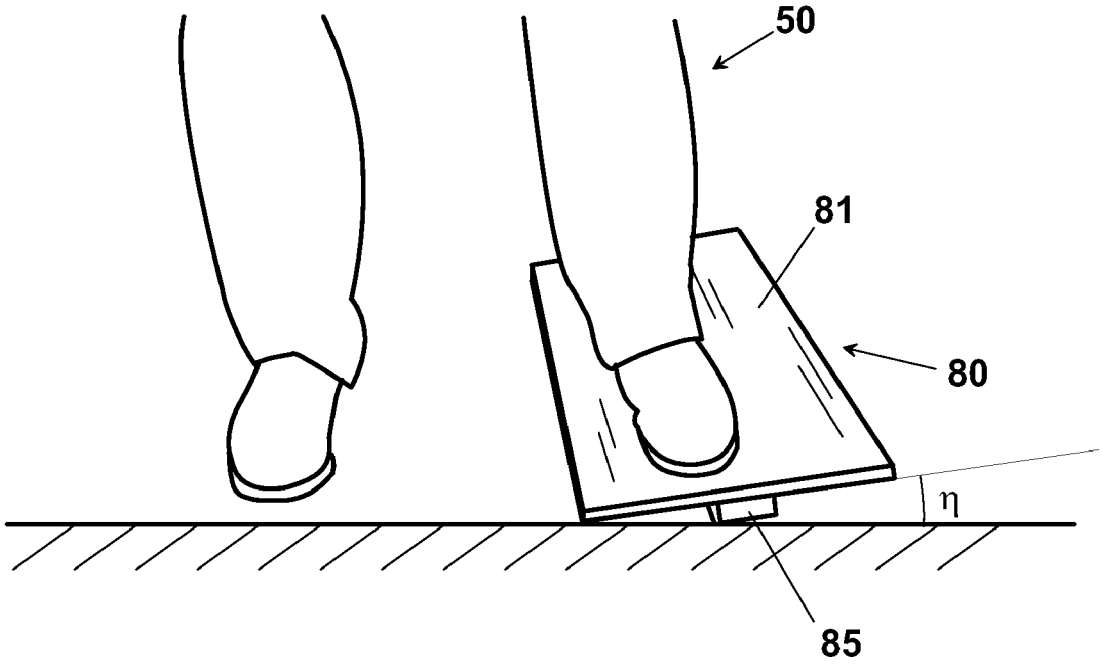
Figure 24:
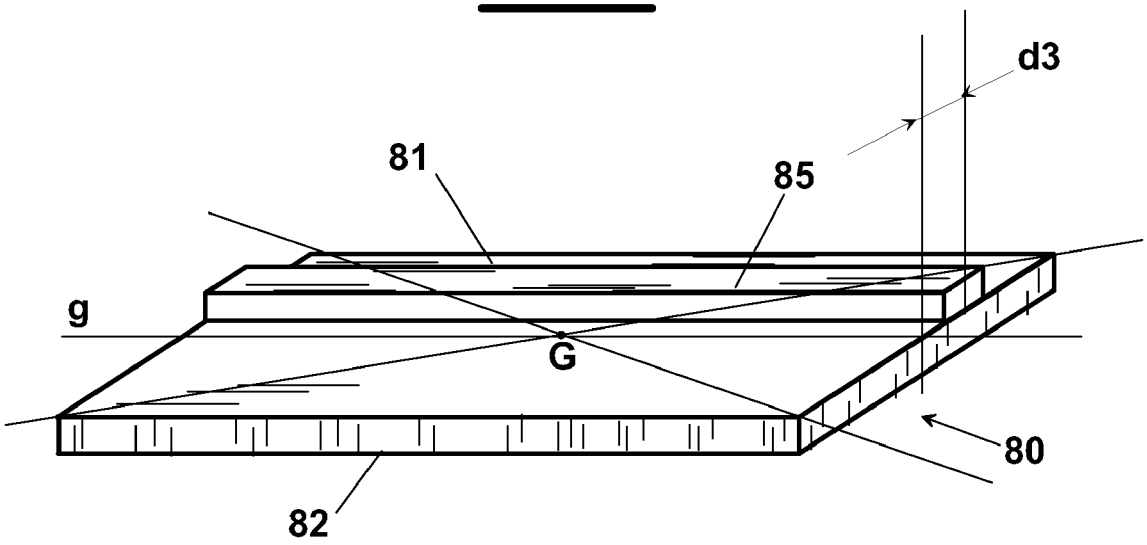
Figure 25:
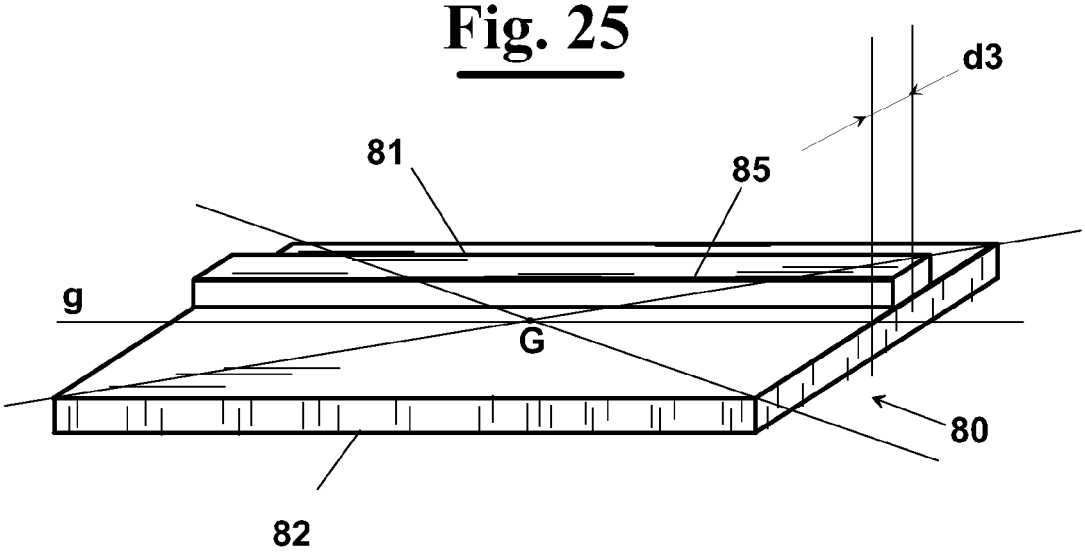

In particular, proprioceptive footboard 80 provides a lower surface 81 that is oriented towards mat 1, and is for example arranged at a footprint for at least one foot, and an upper surface 82, on which in use the golf trainee rests with the feet (FIGS. 21 and 22) or with one foot only (FIG. 23). In a further exemplary embodiment, not shown in the figures, a right foot footboard and a left foot footboard can be provided that the golf trainee can use at the same time.

More in detail, the lower surface 81 of the footboard 80 has a base rod 85, having for example polyhedral cross section and arranged at a distance d3 with respect to line "g", which passes through its geometric barycentre G. Therefore, footboard 80, which rests on a support surface at least at one footprint of the foot of the mat, by rod 85 can rotate, or can rock, with respect to it as the golf trainee 50 loads the body weight on the feet. For example the support surface can be a surface of mat 1. Alternatively, in another exemplary embodiment, not shown, it is possible to remove the portion of the mat that comprises the footprints put the footboard on it.

Therefore, footboard 80 assists golf trainee 50 to get the correct initial posture, and to get a balanced position that corresponds to a correct distribution of the weight of the body on the feet. This condition occurs when the footboard is arranged substantially parallel to the surface on which it is arranged, for example mat 1.

As above anticipated and shown in detail in FIG. 23, footboard 80 can be used in a static configuration, in which it is arranged at only one of the reference footprints, for example the left one, at an angle η. In this case, the golf trainee 50 rests on the footboard 80 with a single foot whereas the other foot is on the other footprint. Therefore, the golf trainee assumes a posture in which the load that bears on the foot that is arranged on the footboard 80 is less than the load that bears on the foot that rests on mat 1. This increases the perception of the golf trainee, i.e. its sensitivity, relatively to the distribution of the weight of the body on the legs.

In particular, rod 85 and lower surface 81 of footboard 80 have releasable engagement means for mutual engagement thereof. This way, rod 85*a*, having for example a width L1 and a height H1, can be replaced with another rod 85*b*, having width L2 and height H2, using always a same footboard 80. This way, it is possible to customize the footboard 80 to the player, or it is possible to provide different configurations on footboard 80.

For example, the releasable mutual engagement means comprises a protruding portion 95 at a face 86 of rod 85 that in use is oriented towards lower surface 81 of footboard 80, in such a way to engage with a recessed portion 83 of lower surface 81. For example, protruding portion 95 may have a "dove-tail" shape for engaging/disengaging with corresponding groove 83.

Alternatively, in an exemplary embodiment not shown in the figures, surface 81 of footboard 80 has the protruding portion and face 86 of rod 85 has the recessed portion. Notwithstanding in the figure the recessed portion is shown having the shape of a groove, it can be a recess of different type. Similarly, the protruding portion can be also a bolt that is adapted to engage with the recess, for example a click engagement.

As shown in FIGS. 27 and 28, the training equipment for golf players can also comprise a device 100 for a causing a resilient reaction on the wrist of the golf trainee 50 during a swing. More in detail, elastic guide device 100 comprises a bracelet 101 that is constrained to the arm of the golf trainee 50, for example by a Velcro fastening, and also comprises a resilient element 102 engaging with bracelet 101 at one end thereof 101*a*, for example engaging it in an bend that protrudes from bracelet 101, and have the other end 101*b* that is constrained to a finger, for example the middle finger of the golf trainee.

When the golf trainee is in a posture in which the projection of the arm is arranged along reference line 14 (FIGS. 8 and 9), the resilient element "recalls" the wrist by "loading" it and avoiding that the golf trainee 50 applies a too high force on the arm.

The resilient guide device 100 for the wrist can be also used by a disabled golf trainee to assist achieving a correct position of the wrist and then loading correctly the arm during a swing.

The foregoing description of a specific embodiment will so fully reveal the invention according to a conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. Training equipment for golf players to assist a golf trainee to execute a correct succession of movements of a swing, said equipment comprising a mat, said mat having a longitudinal dimension and a transversal dimension and having a support surface that is adapted, in use, to be located next to a training area, said mat further comprising a reference surface that is opposite to said support surface, said reference surface comprising:

a golf ball reference position;

reference footprints for the feet; and a plurality of reference lines by means of which the golf trainee orients himself/herself to follow a succession of positions of the body;

wherein said plurality of reference lines comprises a determined number of arm guiding reference lines with respect to which the golf trainee orients the arms as a vertical projection there from in order to follow corresponding body positions according to a predetermined succession of positions.

2. Training equipment for golf players, according to claim 1, wherein, with respect to a tangential line "t" that is tangent at respective points P1 and P2 respectively to the right foot reference footprint and to the reference left foot reference footprint, said arm guiding reference lines comprise a determined number of reference lines that are at an angle with respect to said line "t".

3. Training equipment for golf players, according to claim 2, wherein said reference lines that are at an angle with respect to said tangential line "t" comprise at least one line selected from the group consisting of:

a first reference line at an obtuse angle $\alpha$ that is measured with respect to tangential line "t;"

a second reference line at an acute angle $\beta$ with respect to tangential line "t" that intersects said first reference line in a first point P; and a third reference line that is substantially parallel to said second reference line and intersects said first reference line at a second point T.

4. Training equipment for golf players, according to claim 3, wherein said first reference line passes through said point P1 of the right foot reference footprint and is at said angle $\alpha$ with respect to said line "t".

5. Training equipment for golf players, according to claim 3, wherein a reference line "i" is provided at an acute angle Y with respect to said line "t," said reference line "i" intersecting said left foot reference footprint.

6. Training equipment for golf players, according to claim 5, wherein a reference line "1" is provided that is substantially parallel to said reference line "i" and is arranged more on the left side than said reference line "i".

7. Training equipment for golf players, according to claim 2, wherein P1 and P2 are separated along said tangential line "t" by a distance substantially equal to the distance existing between the shoulders of the golf trainee.

8. Training equipment for golf players, according to claim 2, wherein a reference line "n" is provided for the arms as a vertical projection there from that is substantially parallel to said line "t," said reference line "n" being located opposite to said footprint at a distance from said tangential line "t" equal to half a distance between P1 and P2.

9. Training equipment for golf players, according to claim 8, wherein said second reference line is at an angle $\beta$ set between 44° and 46° with respect to said tangential line "t" and passes through a point P' of intersection of said first reference line with a reference line "n," said reference line "n" passing through intersection point P between said first and said second reference line, whereby P≡P'.

10. Training equipment for golf players, according to claim 2, additionally comprising a start line that is substantially orthogonal to said tangential line "t" and that passes through said point P1, such that a golf trainee aligns a view with said start line for determining a starting posture.

11. Training equipment for golf players, according to claim 1, additionally comprising a second plurality of reference lines that is specularly symmetrical to said first plurality of reference lines in a plane that is transversal to said reference surface of said mat and that passes through said middle point of said line "t".

12. Training equipment for golf players, according to claim 2, additionally comprising a reference line "d" provided at an acute angle $\delta$ with respect to a line j that passes through the golf ball reference position and is parallel to tangential line "t," said acute angle $\delta$ being defined starting from line j in a clockwise direction, said reference line "d" being followed by the golf trainee immediately before hitting the ball in case of a hit of a "draw" type.

13. Training equipment for golf players, according to claim 2, additionally comprising a reference line "f" provided at an acute angle $\rho$ with respect to a line j that passes through the golf ball reference position and is parallel to tangential line "t," said acute angle $\rho$ being defined starting from line j and going in a counter clockwise direction, said reference line "f" being followed by the golf trainee immediately before hitting the ball in case of a hit of a "fade" type.

14. Training equipment for golf players, according to claim 1, additionally comprising a proprioceptive footboard that is adapted to be arranged at least at one reference footprint, oriented towards said mat and comprising a lower surface that in use faces a support surface and an upper surface that is opposite to said support surface on which the golf trainee rests at least one foot, said lower surface being equipped with a base portion by means of which the footboard rests on said support surface, said base portion defining at least one rotation axis about which said footboard can rotate.

15. Training equipment for golf players, according to claim 1, additionally comprising an elastic guide device for the wrist of the golf trainee during a swing, said elastic guide device comprising:

a bracelet that is adapted to be constrained to an arm of the golf trainee; and a resilient elongated element that is connected to the bracelet at an end thereof, said resilient element at an other end engaging in use a finger of the golf trainee.

16. Training equipment for golf players, according to claim 2, wherein said golf ball reference position lays on a line "o" that is substantially orthogonal to said tangential line "t," wherein said line "o" intersects said tangential line "t" at a determined point R in order to determine two portions p1 and p2, with p1 substantially equal to twice p2.

* * * * *